US008162594B2

(12) United States Patent
Guimbard et al.

(10) Patent No.: US 8,162,594 B2
(45) Date of Patent: Apr. 24, 2012

(54) COOLED BLADE FOR A TURBOMACHINE

(75) Inventors: Jean-Michel Bernard Guimbard, Cely en Biere (FR); Philippe Jean-Pierre Pabion, Vaux le Penil (FR); Jean-Luc Soupizon, Vaux le Penil (FR)

(73) Assignee: SNECMA, Paris (FR)

( * ) Notice: Subject to any disclaimer, the term of this patent is extended or adjusted under 35 U.S.C. 154(b) by 736 days.

(21) Appl. No.: 12/253,575

(22) Filed: Oct. 17, 2008

(65) Prior Publication Data

US 2009/0104018 A1 Apr. 23, 2009

(30) Foreign Application Priority Data

Oct. 19, 2007 (FR) ..... 07 07342

(51) Int. Cl.
*F01D 5/14* (2006.01)

(52) U.S. Cl. ..... 415/115

(58) Field of Classification Search ..... None
See application file for complete search history.

(56) References Cited

U.S. PATENT DOCUMENTS

| | | | | |
|---|---|---|---|---|
| 3,301,527 | A | 1/1967 | Kercher | |
| 3,715,170 | A | 2/1973 | Savage et al. | |
| 3,767,322 | A * | 10/1973 | Durgin et al. | 416/97 R |
| 3,921,271 | A | 11/1975 | Dennis et al. | |
| 3,973,874 | A | 8/1976 | Corsmeier et al. | |
| 4,064,300 | A * | 12/1977 | Bhangu | 428/120 |
| 4,077,205 | A * | 3/1978 | Pane et al. | 60/757 |
| 4,086,757 | A | 5/1978 | Karstensen et al. | |
| 4,288,201 | A * | 9/1981 | Wilson | 415/115 |
| 4,859,141 | A * | 8/1989 | Maisch et al. | 415/115 |
| 5,090,866 | A * | 2/1992 | Blair | 415/115 |
| 6,237,344 | B1 * | 5/2001 | Lee | 60/754 |
| 6,582,186 | B2 * | 6/2003 | Manzoori et al. | 416/96 A |
| 7,008,185 | B2 * | 3/2006 | Peterman et al. | 416/96 A |
| 2007/0122281 | A1 | 5/2007 | Dervaux et al. | |

FOREIGN PATENT DOCUMENTS

| | | |
|---|---|---|
| BE | 685.320 | 1/1967 |
| EP | 1 783 326 A1 | 5/2007 |
| FR | 891.635 | 3/1944 |
| FR | 2.117.034 | 7/1972 |
| FR | 2.212.485 | 7/1974 |
| FR | 2 286 277 | 4/1976 |

* cited by examiner

*Primary Examiner* — Scott B Geyer
(74) *Attorney, Agent, or Firm* — Oblon, Spivak, McClelland, Maier & Neustadt, L.L.P.

(57) ABSTRACT

A cooled blade forming an upstream guide vane element for a turbomachine is disclosed. The airfoil includes a longitudinal cavity with a first opening at one end and a second opening at the other end, a tubular sleeve being housed in the cavity with a first end in the first opening and a second end in the second opening, first spacers on the side of the first end, and second spacers on the side of the second end of the sleeve making a space between the outer face of the sleeve and the wall of the cavity. The blade is arranged so that the sleeve is inserted into the cavity through the first opening. The first spacers are secured to the sleeve and the second spacers are secured to the wall of the cavity of the airfoil. The invention makes it possible to mount the sleeve despite an accentuated curvature of the profile of the airfoil.

17 Claims, 4 Drawing Sheets

COOLED BLADE FOR A TURBOMACHINE

CROSS-REFERENCE TO RELATED APPLICATIONS

This application claims priority to FR 07 07342 filed Oct. 19, 2007.

BACKGROUND OF THE INVENTION

Field of the Invention

The present invention relates to the field of turbomachines notably of gas turbine engines and its subject is more particularly the cooled upstream guide vane element blades.

In a gas turbine engine, such as the turbojet with a front turbofan 70 in FIG. 7, the incoming air is compressed in a compressor before being mixed with a fuel and burned in a combustion chamber. The hot gases produced in the chamber drive the downstream turbine or turbines and are then ejected. The various turbine stages 72 are separated by upstream guide vane elements which guide the gas for an appropriate orientation when entering the turbine. Because of the temperature of the gases, the blades, notably those forming the upstream guide vane element at the entrance of the high-pressure turbine and receiving the gases directly from the combustion chamber, are subjected to very severe operating conditions. Cooling means are arranged in the walls that are in contact with the hot gases. The cooling is carried out by forced convection or else by air impact on the inner faces of the walls of the blades.

FIG. 1 represents, in longitudinal section, a blade 1 forming an upstream guide vane element of the prior art wherein the cooling is provided by air impact from a tubular insert forming a multipally perforated inner longitudinal sleeve 4, housed in the cavity 6 of the blade. The airfoil of the blade 1 extends radially between two platforms, a radially inner platform 3 and a radially outer platform 2. The two platforms delimit the annular stream 5 for circulation of the driving gases. The stream is subdivided circumferentially by the airfoils of the blades 1. The two platforms and the airfoil form a single cast part. The sleeve 4 is manufactured by forming a metal sheet and comprises small bosses 41 protruding on its outer face. The small bosses formed by swaging are of a determined height and form spacers between the outer face of the sleeve and the inner face of the cavity 6. They are distributed between the ends of the sleeve. In this instance there are two small bosses close to each end on each of the faces, on the pressure side and suction side respectively. FIG. 2 shows in longitudinal section parallel to the axis of the airfoil, the arrangement of the bosses 41 on the sleeve. They keep the sleeve at a distance from the walls of the airfoil in order to allow both the impact of the air streams on the wall and the circulation of the air in the space thus arranged. An opening 7 in the outer platform supplies the sleeve 4 with cooling air drawn from the compressor for example.

A portion of this air passes through the orifices 42 of the sleeve and cools the wall of the blade by impact. This air then flows downstream where it is discharged into the gas stream through perforations provided along the wall of the trailing edge of the airfoil. It should be noted that the inner face of the wall of the airfoil may be provided with flow disrupting elements 61 which promote the thermal exchanges between the air circulating in the cavity and the wall. The rest of the air circulating radially inside the sleeve is guided across the inner platform 3 up to a tube 8 which directs it toward other turbomachine portions to be cooled, such as the turbine disk or else the bearings.

The blade is open, at 9 and 10, to the two longitudinal ends of the airfoil, respectively at its outer platform 2 and its inner platform 3. On assembly, the sleeve that has previously been formed is slid into the cavity 6 of the blade through the opening 9. The sleeve is then secured to the blade by welding or brazing along its edge in contact with the wall of the opening 9. The opposite portion of the sleeve is guided into the inner opening 10 of the blade which forms a slide in order to allow relative movements between the blade and the sleeve. These longitudinal movements are due to the temperature variations during the operation of the turbomachine and to the fact that both parts differ by the nature of the materials they are made of and the way they are manufactured.

One particular embodiment of the sleeve inside the cavity is described in the patent EP 1508670 in the name of the applicant.

The performance of the turbomachine is enhanced by a modification of the shape of the upstream guide vane elements. When the airfoil of the upstream guide vane element defined aerodynamically is twisted and has a profile having a twist about its longitudinal axis, for example, and leading edges and trailing edges that are not parallel with one another, difficulties are encountered in mounting the sleeve in the cavity of the airfoil and removing it therefrom. The representation of the geometric casings of the cavity of the airfoil and of the outer face of the sleeve with its small bosses shows, according to the envisaged embodiments, zones of interference. The presence of these zones is capable of making it impossible to install the sleeve inside the cavity according to the prior art.

BRIEF SUMMARY OF THE INVENTION

The applicant has therefore set itself the objective of remedying this disadvantage.

For this reason, according to the invention, the cooled blade of a turbomachine, comprising a platform and an airfoil, and comprising a cavity along the airfoil and the platform with a first opening at one end and a second opening at the other end, a tubular sleeve being housed in the cavity with a first end in the first opening and a second end in the second opening, first spacers on the side of the first end and second spacers on the side of the second end of the sleeve creating a space between the outer face of the sleeve and the wall of the cavity, the blade being arranged so that the sleeve is inserted into the cavity through the first opening is remarkable for the fact that the first spacers are secured to the sleeve and the second spacers are secured to the wall of the cavity along the airfoil.

The solution of the invention makes it possible, with minor modifications both to the metal sleeve and to the inner face of the airfoil, to reserve a larger lateral clearance between the insert and the wall of the cavity. This therefore gives greater freedom in the choice of the geometry of the airfoil from an aerodynamic point of view.

The result of this is a greater capacity to enhance the output and performance of the turbine.

More particularly, the first spacers are placed in a direction forming an angle with the chord of the blade. The angle is zero in particular.

According to a preferred embodiment, the sleeve is formed of a metal sheet, the first spacers being bosses obtained by deformation of the metal sheet. The bosses are for example dome-shaped.

The first spacers are advantageously arranged in the half of the sleeve situated on the side of the first end, therefore leaving a maximum lateral movement capacity, because of the space requirement, while the first spacers are not engaged in the cavity.

The second spacers form individual bosses. They are preferably aligned parallel to the chord.

According to a variant, the second spacers have an elongated shape parallel to a chord of the blade. More particularly, the second spacers form a continuous rail, they thereby perform an additional sealing function limiting the air leaks from inside the sleeve through the space left free between the sleeve and the slide.

The solution of the invention has a particular value when the sleeve is perforated for cooling by air impact of the walls of the airfoil.

The first opening is either on the outside of the gas stream or on the inside of the gas stream.

The invention also relates to a method for assembling the blade wherein the user places the sleeve in the cavity by inserting it by its second end through the first opening.

BRIEF DESCRIPTION OF THE SEVERAL VIEWS OF THE DRAWINGS

A nonlimiting embodiment of the invention is described in greater detail below with reference to the appended drawings in which.

DETAILED DESCRIPTION OF THE INVENTION

Figure 1:
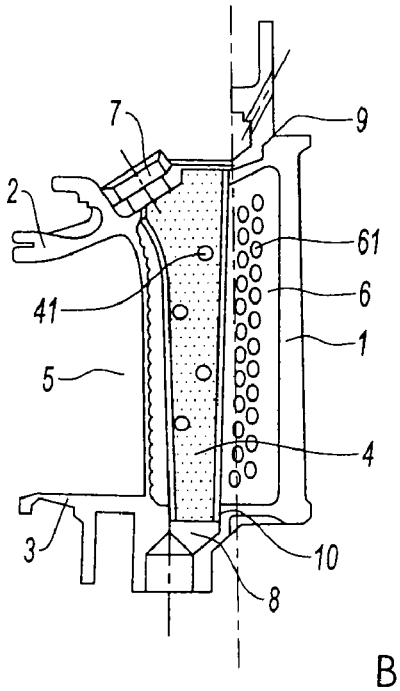
Fig. 1 BACKGROUND ART
FIG. 1 shows in longitudinal section a cooled upstream guide vane element blade of the prior art with an inner sleeve for distributing cooling air.
Figure 2:
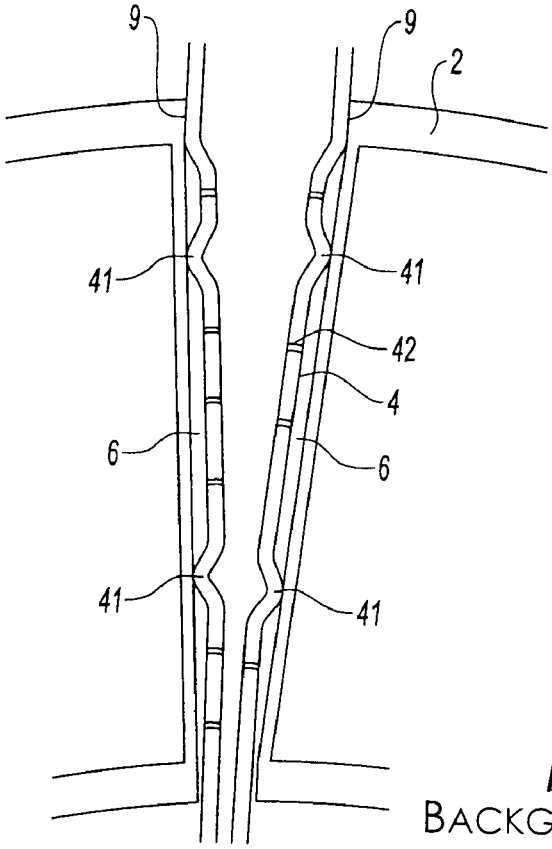
Fig. 2 BACKGROUND ART
FIG. 2 is a longitudinal section of the blade of FIG. 1 showing the spacers arranged on the sleeve.
Figure 3:
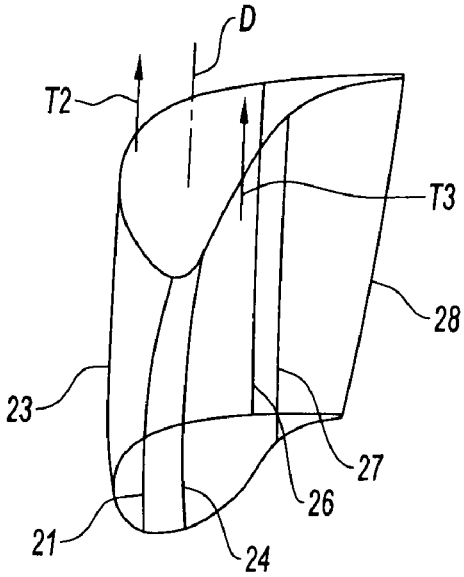
FIG. 3 is an example of a complex geometry blade profile.

The upstream guide vane element airfoil profile 20 of FIG. 3 shows a leading edge 21 and a trailing edge 28 whose curvatures vary between the root of the airfoil and its tip. The longitudinal directrix lines 23 and 24 for example, or else 26 and 27, also see their curvature change. It is understood that a tubular inner sleeve with the volume defined by this profile cannot be moved in the longitudinal direction without the casings interfering in their translation. Any interference corresponds to an impossibility of movement.

In this case, installation or removal becomes impossible. FIG. 3 illustrates this problem; the sleeve cannot be slid into the cavity unless the blade has one and the same orientation of curvature between the leading edge and the trailing edge. This is not the case with the part of FIG. 3 where the curvatures of the leading edge 21 and of the trailing edge 28 are inverted. Specifically, searching for the preferred direction of installation/removal is defined as follows. If, at each point, the straight line tangential to the leading edge curve and the straight line tangential to the trailing edge curve is considered, the preferred direction would be the line bisecting the angle formed by the two tangential straight lines, see tangent T2, tangent T3 and average direction D in the figure. The translation in this preferred direction is not allowed or is extremely limited in the present case because of the change of the angle and therefore of the bisecting line over the height of the airfoil. This change results from the fact that there is inversion of the direction of curvature between the curves 21 and 28, but also between the curves of the intermediate directrix lines 23-24 on the one hand and 26-27 on the other hand.

The casing of the sleeve is defined by the bosses that protrude on its surface. Because these bosses have a function as spacers and to maintain a well-determined air gap, their casing is very close to the geometric casing of the inner surface of the wall of the airfoil. Any variation of curvature is therefore able to prevent their relative movement.

Figure 4:
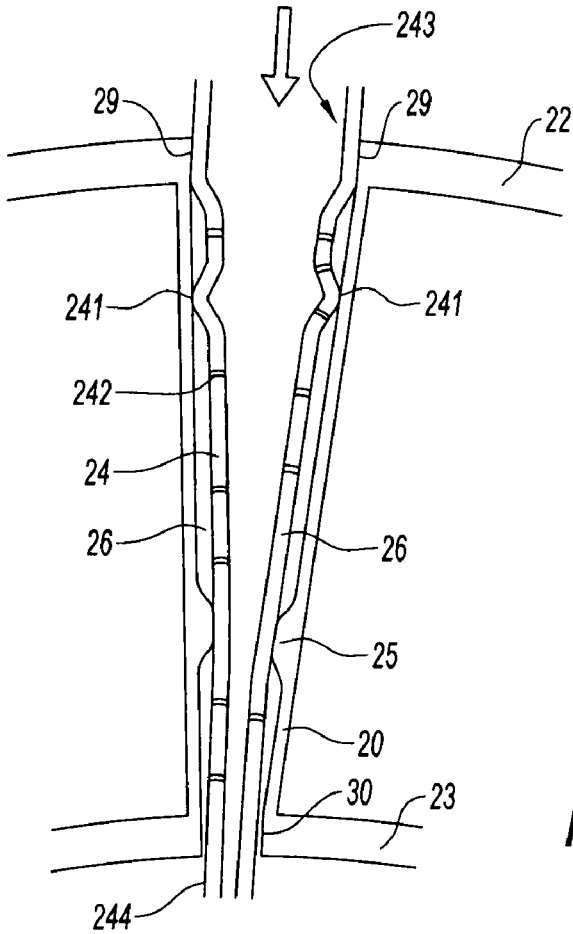
FIG. 4 is a view in longitudinal section of a blade according to the invention.

The solution of the invention consisted in modifying the distribution of the spacers between the sleeve and the airfoil. FIG. 4 shows in longitudinal section a blade according to the invention. The airfoil 20 extends between an inner platform 23 and an outer platform 22. The two platforms are the borders of the annular stream traveled by the driving gases. The sleeve 24 inside the cavity 26 of the airfoil is welded or brazed by its first end 243 to the wall of the first opening 29. This opening 29 is made in the wall of the outer platform 22. The other end 244 of the sleeve is engaged in the second opening 30 made in the inner platform 23. Being secured to the airfoil by one end, 243, and free at its other end, 244, the two parts may expand independently of one another.

On the side of its first end 243, the sleeve comprises bosses formed by deformation of the metal sheet. These bosses form spacers keeping the wall of the sleeve at a distance from the wall of the cavity. They are for example aligned parallel to the direction of the chord of the blade.

The sleeve does not comprise other bosses as is clearly seen in FIG. 4.

Protrusions 25 arranged on the inner face of the wall of the airfoil 20 form spacers and keep the sleeve away from the wall of the cavity. These protrusions are situated close to the second opening 30. They are made with the blade by casting. Preferably they form spacers of the same height as the bosses 241 so that the space for the circulation of cooling air is the same between the root of the airfoil and its tip. However, the solution of the invention allows a different arrangement of the spacers. These protrusions may be parallel to a chord of the blade. Advantageously they are elongated in shape.

In operation, the cooling air is injected through the first end 243 into the tubular channel of the sleeve; a portion of this air traverses the sleeve through the perforations 242 and divides into thin jets which cool the wall of the airfoil 20. The air then circulates in the space between the sleeve and the wall in order to be ejected toward the trailing edge. Another portion of the air flows through the second end and is guided toward another cooling circuit.

Figure 5:
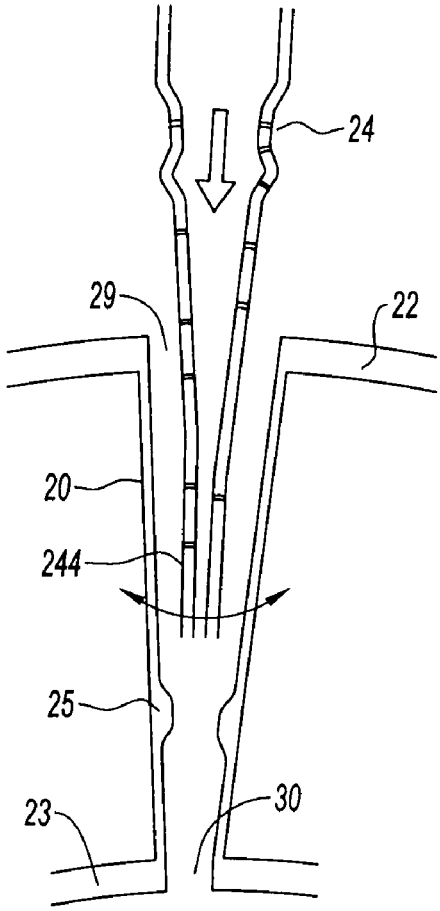
FIG. 5 shows the step of assembling the blade wherein the sleeve is inserted into the cavity of the airfoil.

FIG. 5 shows the value of the solution at the time of assembly. The sleeve is inserted by its second end 244 into the cavity 26 through the first opening 29 of the blade. Since the lower portion of the sleeve, in the figure, does not comprise any transverse protrusion, the user has a certain lateral movement capacity. This capacity is retained until the second end is engaged in the space defined by the protrusions 25. These protrusions are placed close to the second opening 30. The sleeve, at this moment, is close to its engagement in the second opening. Its movement is virtually completed.

Figure 6:
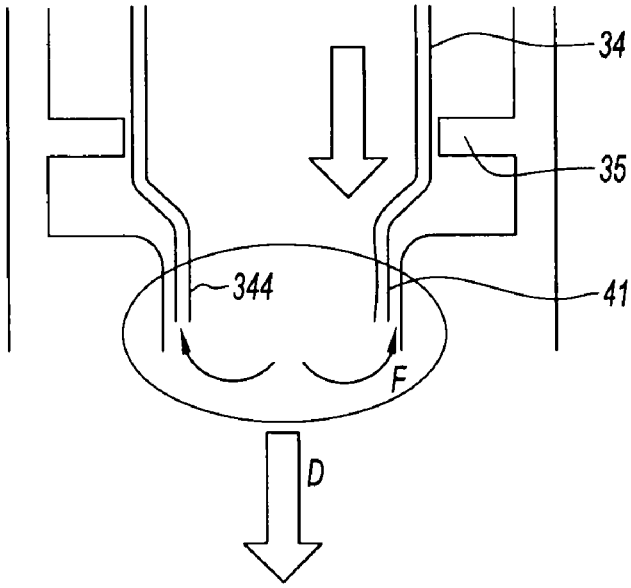
FIG. 6 shows a variant embodiment of the spacers on the side of the second opening of the airfoil.
Figure 7:
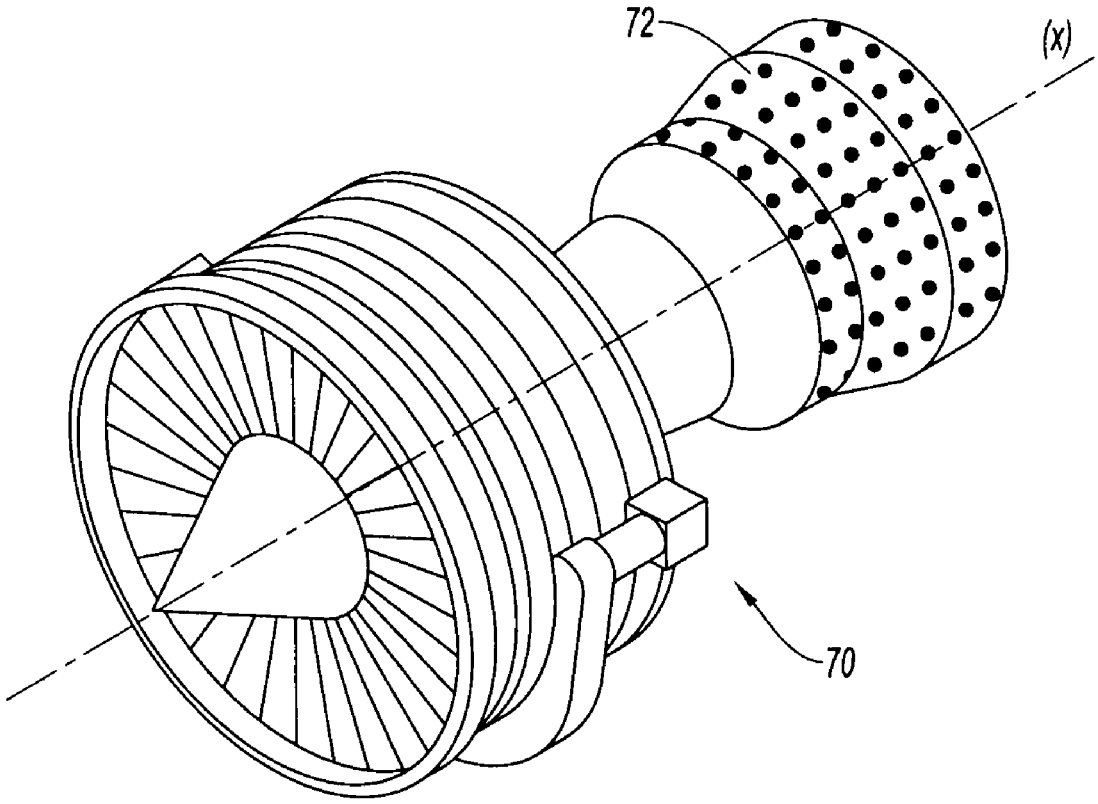
FIG. 7 shows an engine capable of incorporating the blade according to the invention.

FIG. 6 shows a variant embodiment. It represents only the portion of the airfoil 40 close to the second opening 41. The sleeve 34 is engaged by its second end 344 in the second opening 41 of the airfoil. The bosses have been replaced by a rail 35 which runs over the whole periphery, preferably parallel to the plane of the opening 41. Its function is to form a chicane limiting the circulation of the air from one side of the rail to the other. The value of this variant comes from the air leaks which occur between the sleeve at 344 and the wall of the airfoil in the slide of the opening 41. Specifically, in order not to prevent the sleeve from sliding freely in the slide as a result of the dimensional variations between them, a certain clearance must be maintained which is the cause of the air leaks. A portion F of this air is diverted from the planned direction D. The movement of this air in the space between the sleeve and the airfoil is undesirable because it is lost without having contributed to the cooling. The arrangement of such a chicane therefore helps to contain the air inside the sleeve.

The invention claimed is:

1. A cooled blade for a turbomachine, comprising:

an inner platform;

an outer platform an airfoil extending between the inner platform and the outer platform;

a cavity along the airfoil and the inner and outer platforms with a first opening in the outer platform and a second opening in the inner platform;

a tubular sleeve being housed in the cavity with a first end in the first opening and a second end in the second opening; and first spacers on the side of the first end of the sleeve and second spacers on the side of the second end of the sleeve creating a space between an outer face of the sleeve and a wall of the cavity, the blade being arranged so that the sleeve is inserted into the cavity through the first opening, wherein the first spacers are bosses provided on the sleeve and the second spacers are protrusions provided in the wall of the cavity along the airfoil, and wherein the second end of the sleeve is free of protrusions and is engaged with the second spacers provided in the wall of the cavity.

2. The blade as claimed in claim 1, wherein the first spacers are placed in a direction forming an angle with the chord of the blade.

3. The blade as claimed in claim 2, wherein the angle is zero.

4. The blade as claimed in claim 1, wherein the sleeve is formed of a metal sheet, and the bosses are obtained by deformation of the metal sheet.

5. The blade as claimed in the claim 4, wherein the bosses are dome-shaped.

6. The blade as claimed in claim 1, wherein the first spacers are arranged in the half of the sleeve situated on the side of the first end.

7. The blade as claimed in claim 1, wherein the second spacers form individual bosses.

8. The blade as claimed in claim 7, wherein the bosses are aligned parallel to the chord.

9. The blade as claimed in claim 1, wherein the second spacers have an elongated shape parallel to a chord of the blade.

10. The blade as claimed in claim 9, wherein the second spacers form a continuous rail.

11. The blade as claimed in claim 1, wherein the sleeve is perforated for cooling by air impact of the walls of the airfoil.

12. The blade as claimed in claim 11, wherein the first opening is on an inside of a gas stream.

13. The blade as claimed in claim 1, wherein the first opening is on an outside of a gas stream.

14. A method for assembling the blade as claimed in claim 1, comprising:

placing the sleeve in the cavity by inserting it by its second end through the first opening.

15. An upstream guide vane element of a turbomachine comprising a blade as claimed in claim 1.

16. A turbine comprising an upstream guide vane element as claimed in claim 15.

17. A turbomachine comprising at least one blade as claimed in claim 1.

* * * * *